US009089965B1

(12) United States Patent
Cheng

(10) Patent No.: US 9,089,965 B1
(45) Date of Patent: Jul. 28, 2015

(54) TOOL BOX WITH MULTIPLE BOXES

(71) Applicant: Chin-Shun Cheng, Taichung (TW)

(72) Inventor: Chin-Shun Cheng, Taichung (TW)

( * ) Notice: Subject to any disclaimer, the term of this patent is extended or adjusted under 35 U.S.C. 154(b) by 0 days.

(21) Appl. No.: 14/215,064

(22) Filed: Mar. 17, 2014

(51) Int. Cl.

| | |
|---|---|
| ***A45C 11/00*** | (2006.01) |
| ***B25H 3/02*** | (2006.01) |
| ***B65D 25/28*** | (2006.01) |
| ***B65D 43/16*** | (2006.01) |

(52) U.S. Cl.
CPC ..... *B25H 3/023* (2013.01); *B65D 25/2867* (2013.01); *B65D 43/16* (2013.01)

(58) Field of Classification Search
CPC ..... B25H 3/023; A45C 11/24
USPC ..... 206/372, 743, 745, 373, 374, 375; 220/826, 846, 23.88
See application file for complete search history.

(56) References Cited

U.S. PATENT DOCUMENTS

| | | | | | |
|---|---|---|---|---|---|
| 1,675,484 | A | * | 7/1928 | Coe | 312/244 |
| 1,992,435 | A | * | 2/1935 | Labadie et al. | 190/17 |
| 2,347,270 | A | * | 4/1944 | Larsson | 312/244 |
| D153,828 | S | * | 5/1949 | Settle | D3/284 |
| 2,488,067 | A | * | 11/1949 | Roark | 312/200 |
| 2,491,374 | A | * | 12/1949 | Gold | 190/17 |
| 4,621,308 | A | * | 11/1986 | Holmberg et al. | 362/154 |
| 2004/0168941 | A1 | * | 9/2004 | Cho | 206/373 |
| 2007/0159040 | A1 | * | 7/2007 | Fernandez et al. | 312/348.3 |

* cited by examiner

*Primary Examiner* — Steven A. Reynolds
*Assistant Examiner* — King M Chu

(57) ABSTRACT

A tool box includes a first box and second boxes are overlapped in pairs on the first box to form at least one layer. The second boxes located at the lowest layer are pivotably connected to two sides of the first box by first links and first plates. The second boxes of two adjacent layers are pivotably connected to each other by second links and second plates. The first link and the second link each have a first contact portion. The first links each have a protrusion link extending therefrom. The first and second plates each have a second contact portion. When the second boxes are expanded relative to the first box and the second boxes of the adjacent layer, the first contact portions contact the second contact portions. At least one handle is pivotably connected to the protrusion links of the first links on the two sides of the first box.

18 Claims, 21 Drawing Sheets

TOOL BOX WITH MULTIPLE BOXES

BACKGROUND OF THE INVENTION

1. Fields of the Invention

The present invention relates to a tool box, and more particularly, to a tool box with multiple second boxes overlapped on the first box, and the second boxes are expanded relative to the first box.

2. Descriptions of Related Art

The conventional multiple-layer tool box is disclosed in U.S. Pat. No. 2,710,093 which discloses a first box with multiple layers of second boxes which are located side by side, the second boxes of each layer is pivotably connected to the first box by a first link and two second links so that the second boxes can be expanded laterally. When the second boxes are expanded, they are positioned by connection links with a handle located at the middle of the connection links, and a locking unit. When the connection links are raised along guide rails to a certain height, the connection links move the push links which drive the first link so that the second boxes are raised and expanded laterally. The first link and two second links pivotably connect the first box and the second boxes to form a four-link mechanism which is also used in Taiwan Publication No. 579929. However, the second boxes of each layer are expanded even if one of which is not used, and the expanded second boxes occupy space and foreign objects my drop into the opened second boxes. The U.S. Pat. No. 2,710,093 requires the locking unit. The cover connected with the connection links cannot be opened and this is not convenient for the users. For the Taiwan Publication No. 579929, the second boxes on the top are supported by a portion of the lower second boxes, and this means that the open space of the second boxes is limited.

The present invention intends to provide a tool box to improve the shortcomings mentioned above.

SUMMARY OF THE INVENTION

The present invention relates to a tool box and comprises a first box and second boxes are overlapped in pairs on the first box to form at least one layer. The second boxes located at the lowest layer are pivotably connected to two sides of the first box by first links and first plates. The second boxes of two adjacent layers are pivotably connected to each other by second links and second plates. The first link and the second link each have a first contact portion. The first links each have a protrusion link extending therefrom. The first and second plates each have a second contact portion. When the second boxes are expanded relative to the first box and the second boxes of the adjacent layer, the first contact portions contact the second contact portions. At least one handle is pivotably connected to the protrusion links of the first links on the two sides of the first box.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
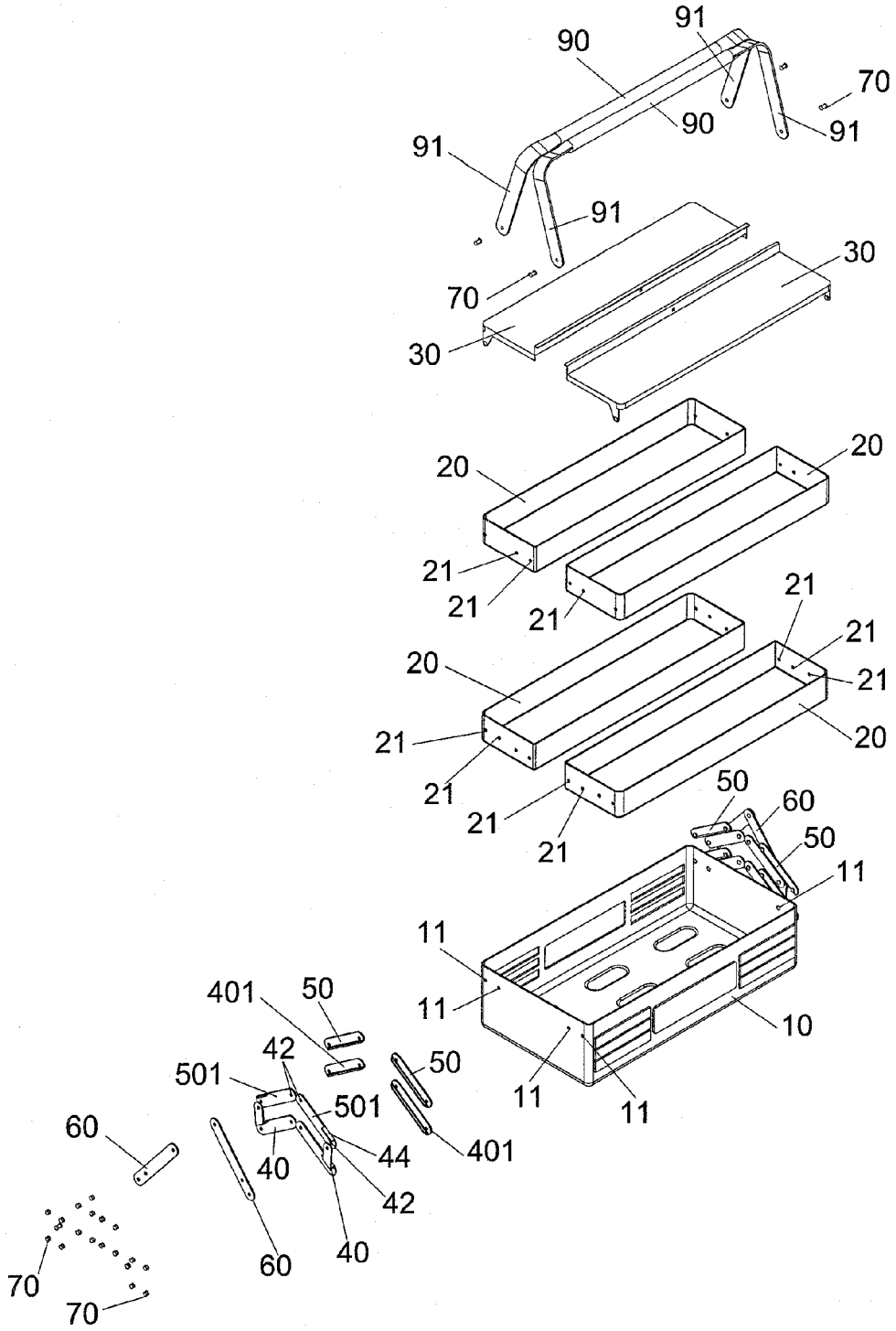
FIG. 1 is an exploded view of the tool box of the present invention.
Figure 2:
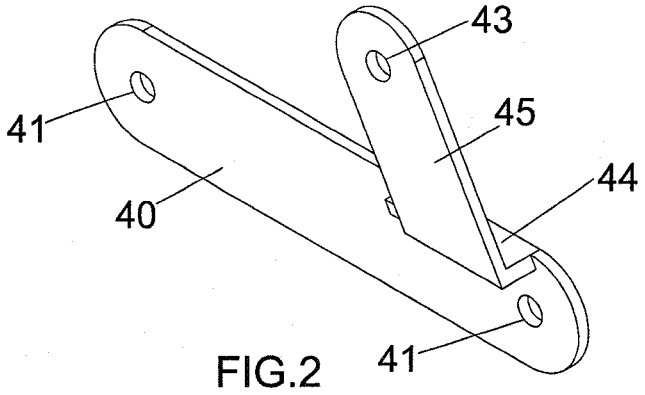
FIG. 2 is a perspective view of the first link of the tool box of the present invention.
Figure 3:
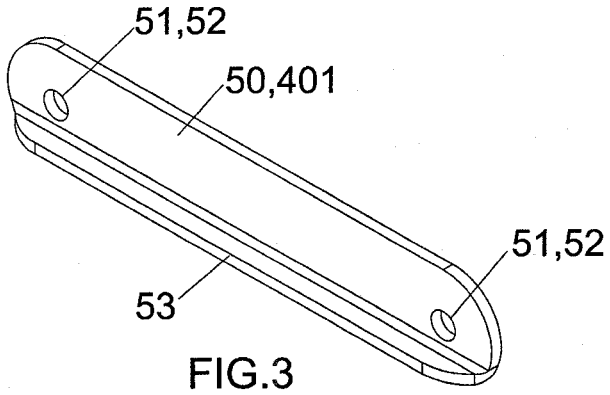
FIG. 3 is a perspective view of the first and second plates of the tool box of the present invention.
Figure 4:
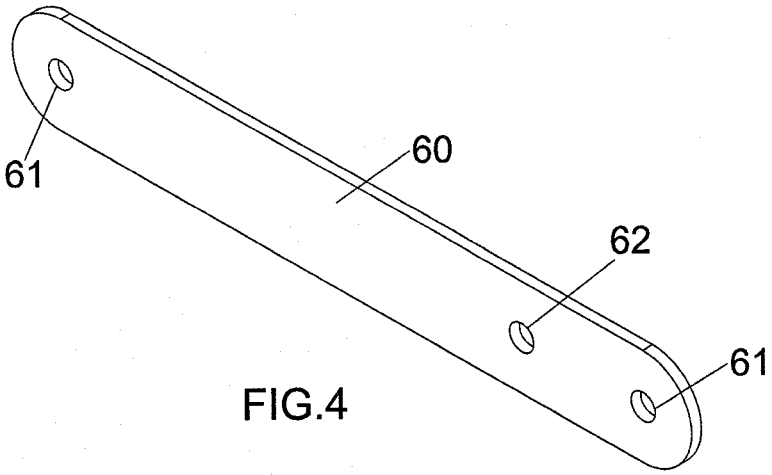
FIG. 4 is a perspective view of the connection plate of the tool box of the present invention.

Referring to FIGS. 1 to 4, the tool box of the present invention comprises a first box 10, at least two second boxes 20, two covers 30, and at least one handle 90. The first box 10 has a space defined therein so as to receive tools.

At least two second boxes 20 are overlapped in pairs on the first box 10 to form at least one layer. Each layer includes two second boxes 20 abreast. The second boxes 20 located at the lowest layer are pivotably connected to two sides of the first box 10 by first links 40 and first plates 401. The at least two second boxes 20, the first links 40 and the first plates 401 together form a parallel four-link mechanism by extending pivots 70 through the corresponding holes 11/21/41/52. The second boxes 20 of two adjacent layers are pivotably connected to each other by second links 501 and second plates 50. The second boxes 20 of the adjacent layers, the second links 501 and the second plates 50 together form another parallel four-link mechanism extending pivots 70 through the corresponding holes 21/42/51. The first link 40 and the second link 501 each have a first contact portion 44 extending laterally therefrom. The first links 40 each have a protrusion link 45 extending from one side thereof. The first plates 401 and the second plates 50 each have a second contact portion 53 extending laterally therefrom. When the second boxes 20 are expanded relative to the first box 10 and the second boxes 20 of the rest of the layers, the first links 40 and the first plates 401 are pivoted simultaneously so that the first contact portions 44 of the first links 40 on the same side of the first box 10 contact the second contact portions 53 of the first plates 401, the first contact portions 44 of the second links 501 on the same side of the first box 10 contact the second contact portions 53 of the second plates 50. The second links 501 and the second plates 50 are pivoted simultaneously so that the second contact portions 44 of the first links 40 on the same side of the first box 10 contact the second contact portions 53 of the first plates 401.

Each cover 30 is pivotably connected with the corresponding second box 20 on the top most layer so as to cover up the second boxes 20 on the top most layer. The at least one handle 90 has two ends pivotably connected to the protrusion links 45 of the first links 40 on the two sides of the first box 10. The first links 40, the second links 501, the first plates 401, the second plates 50 and the protrusion links 45 are elongate plates. The protrusion link 45 extends from the distal end of the first contact portion 44. The contact area between the first contact portion 44 and the second contact portion 53 is a flat surface. The width of the flat surface is larger than the thickness of the first link 40, the first plate 401, the second link 501 and the second plate 50. In the drawings, each protrusion link 45 has a hole 43 through which the pivot 70 extends so as to be pivotably connected to the hole 61 in one end of the connection plate 60. The other two respective ends of the two connection plates 60 on the same side of the first box 10 are pivotably connected to each other by extending a pivot 70 through the holes 61 in the other two respective ends of the connection plates 60. Each of the connection plates 60 has a hole 61 defined through the middle portion thereof, a pivot 70 extends through the hole 61 in the middle portion of the connection plate 60 to be pivotably connected to the arm 91 of the handle 90.

Figure 5:
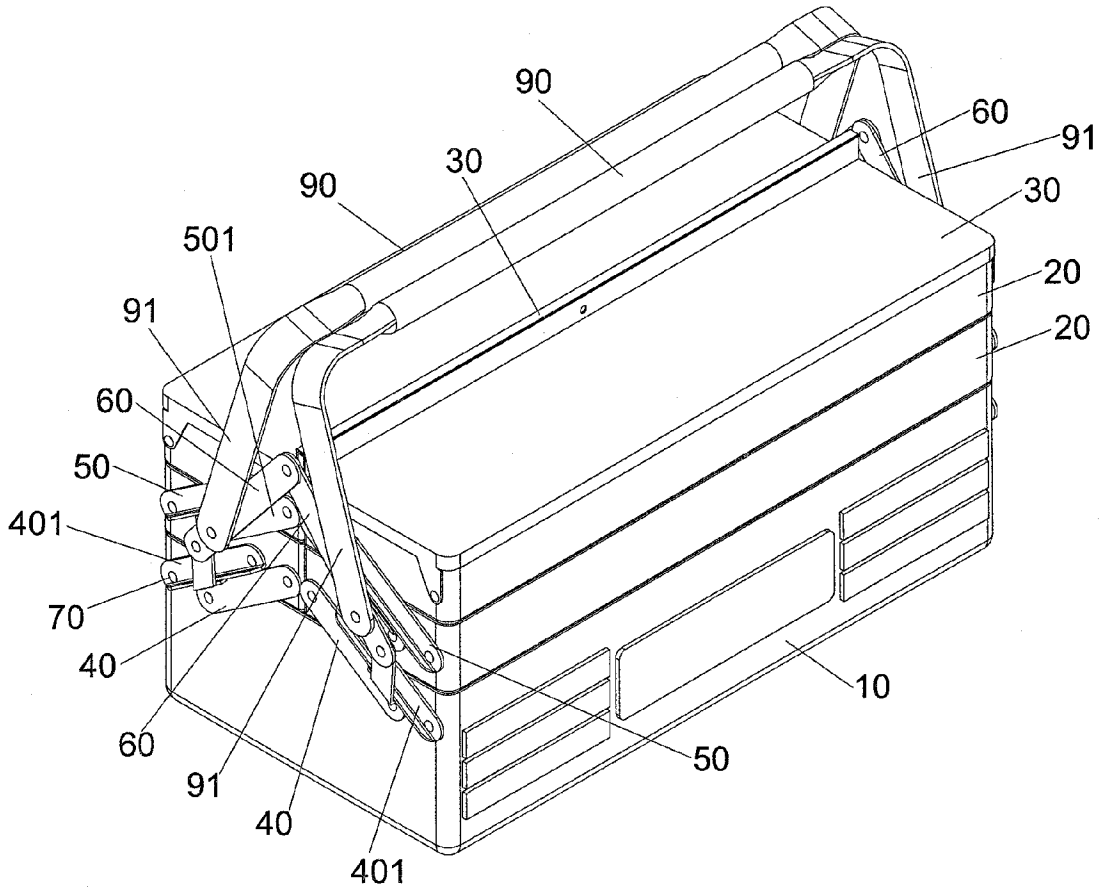
FIG. 5 is a perspective view of the tool box of the present invention.

As shown in FIG. 5, there are even numbers of the second boxes 20 and covers 30 are overlapped on the first box 10, the second boxes 20 of each of the layers can be expanded or folded laterally.

Figure 6:
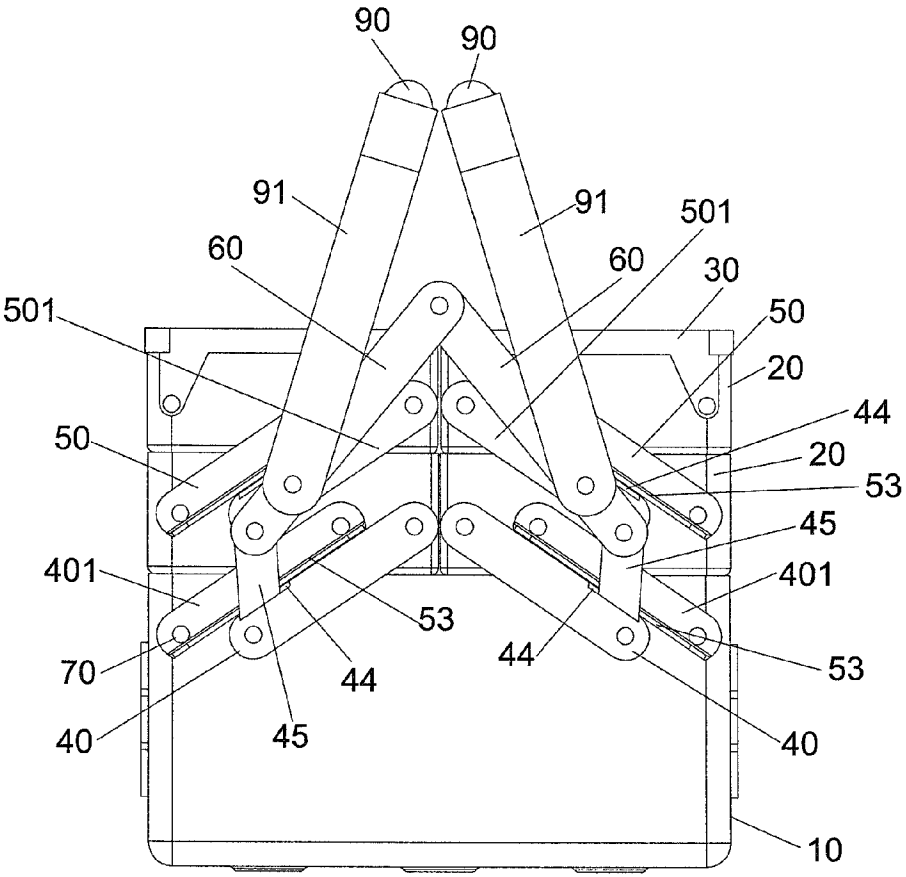
FIG. 6 is a side view of the tool box of the present invention.

As shown in FIG. 6, when the tool box is in the folded status, the first contact portion 44 contacts the second contact portion 53, and the second contact portion 53 contacts the top of the first contact portion 44 to make the tool box be more stable.

Figure 7:
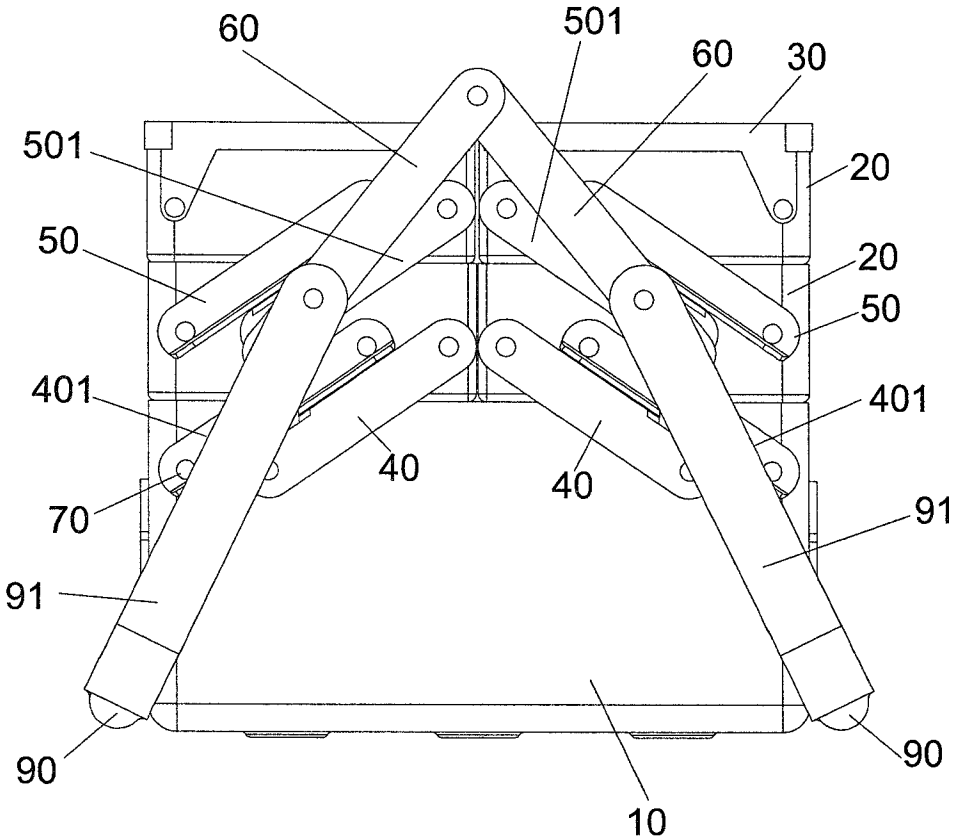
FIG. 7 is a side view of the folded status of the tool box of the present invention.

As shown in FIG. 7, when the tool box is in the folded status, the handle 90 can be positioned on two sides of the first box 10 to reduce the space required.

Figure 8:
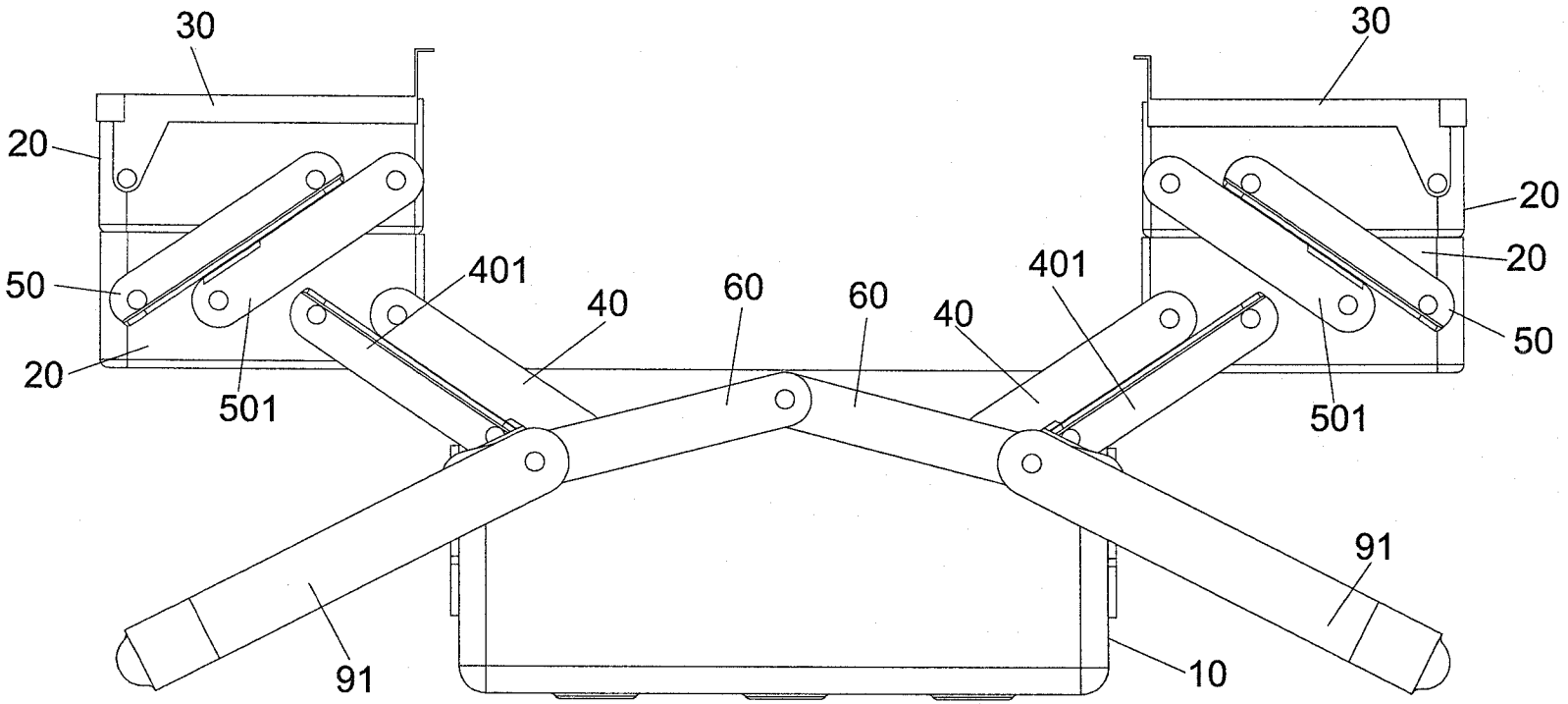
FIG. 8 is a side view to show that the second boxes of the first layer of the tool box of the present invention are expanded.

As shown in FIG. 8, when the second boxes 20 are expanded relative to the first box 10, the first contact portion 44 contacts the top of the second contact portion 53 to form the support. The connection plates 60 and the arms 91 of the handle 90 are located almost on a straight line. There is no overlapped portion between the first box 10 and the second boxes 20 so that the users can easily access the first and second boxes 10, 20.

Figure 9:
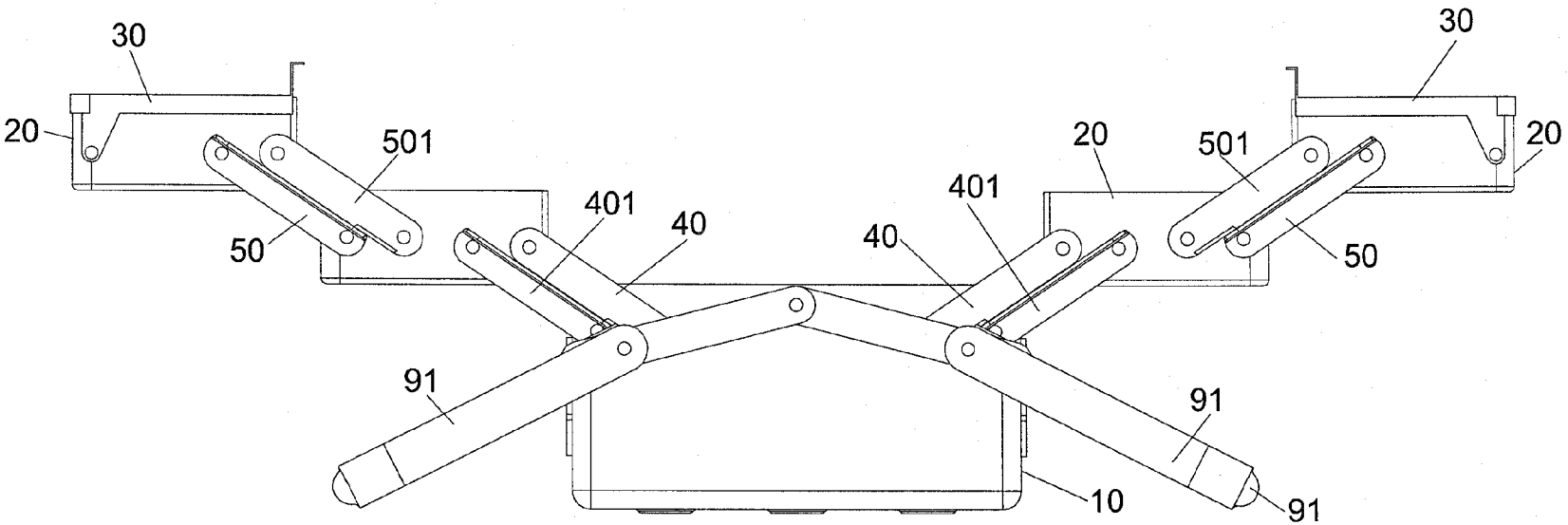
FIG. 9 is a side view to show that the second boxes of the first and second layers of the tool box of the present invention are expanded.
Figure 10:
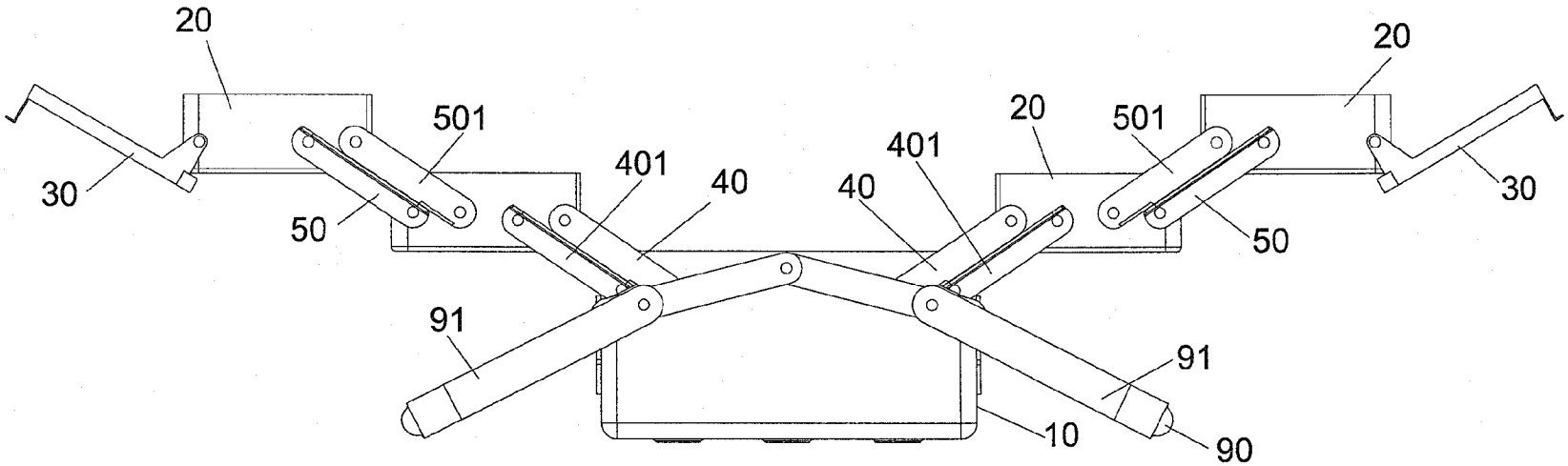
FIG. 10 is a side view to show that all of the second boxes of the tool box of the present invention are expanded.
Figure 11:
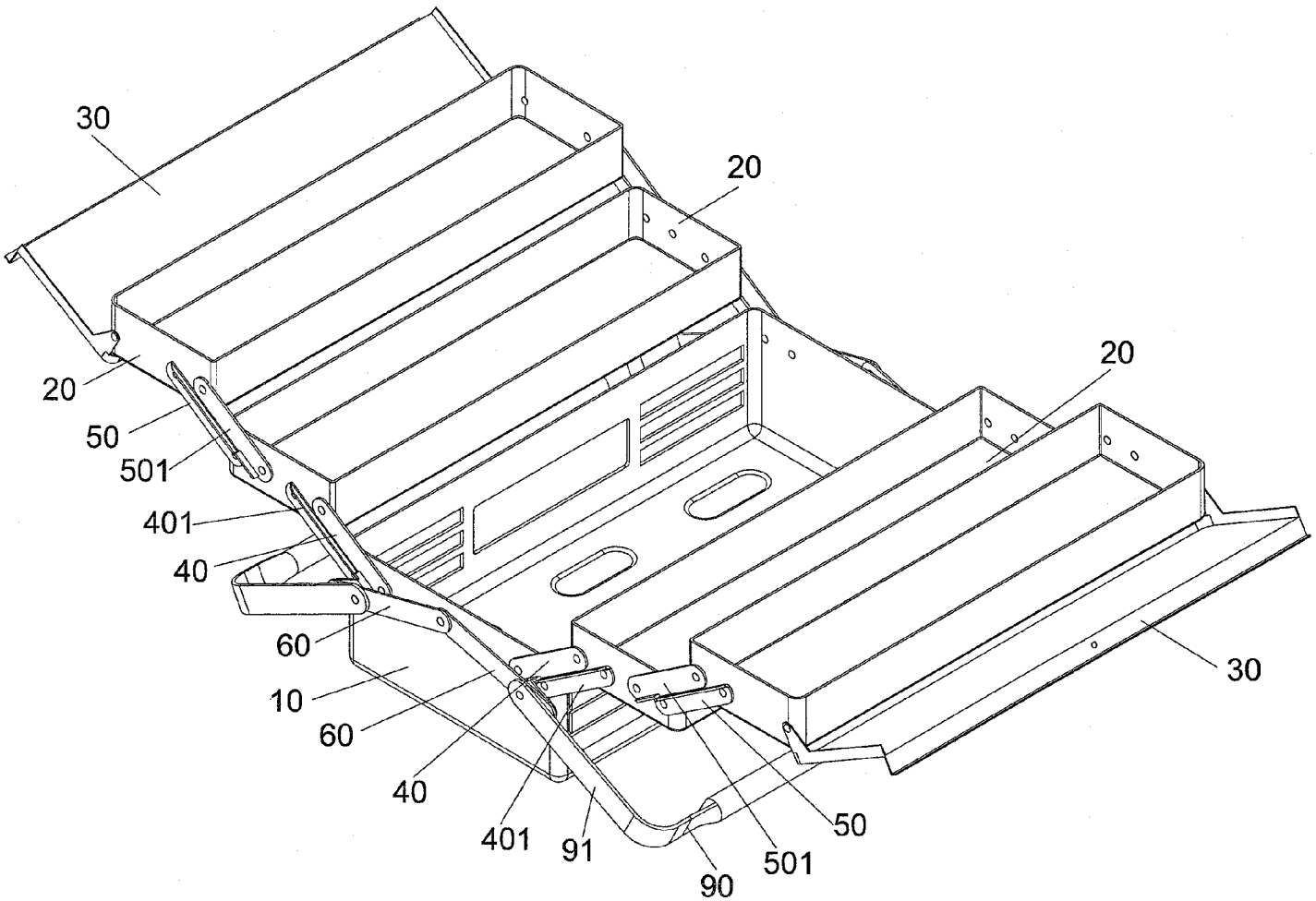
FIG. 11 is a view to show that all of the second boxes of the tool box of the present invention are expanded.

As shown in FIGS. 9 to 11, when the second boxes 20 are expanded relative to the first box 10, the first contact portion 44 contacts the second contact portion 53. There is no overlapped portion between the first box 10 and the second boxes 20, and between the second boxes 20 of different layers so that the users can easily access the first and second boxes 10, 20.

Figure 12:
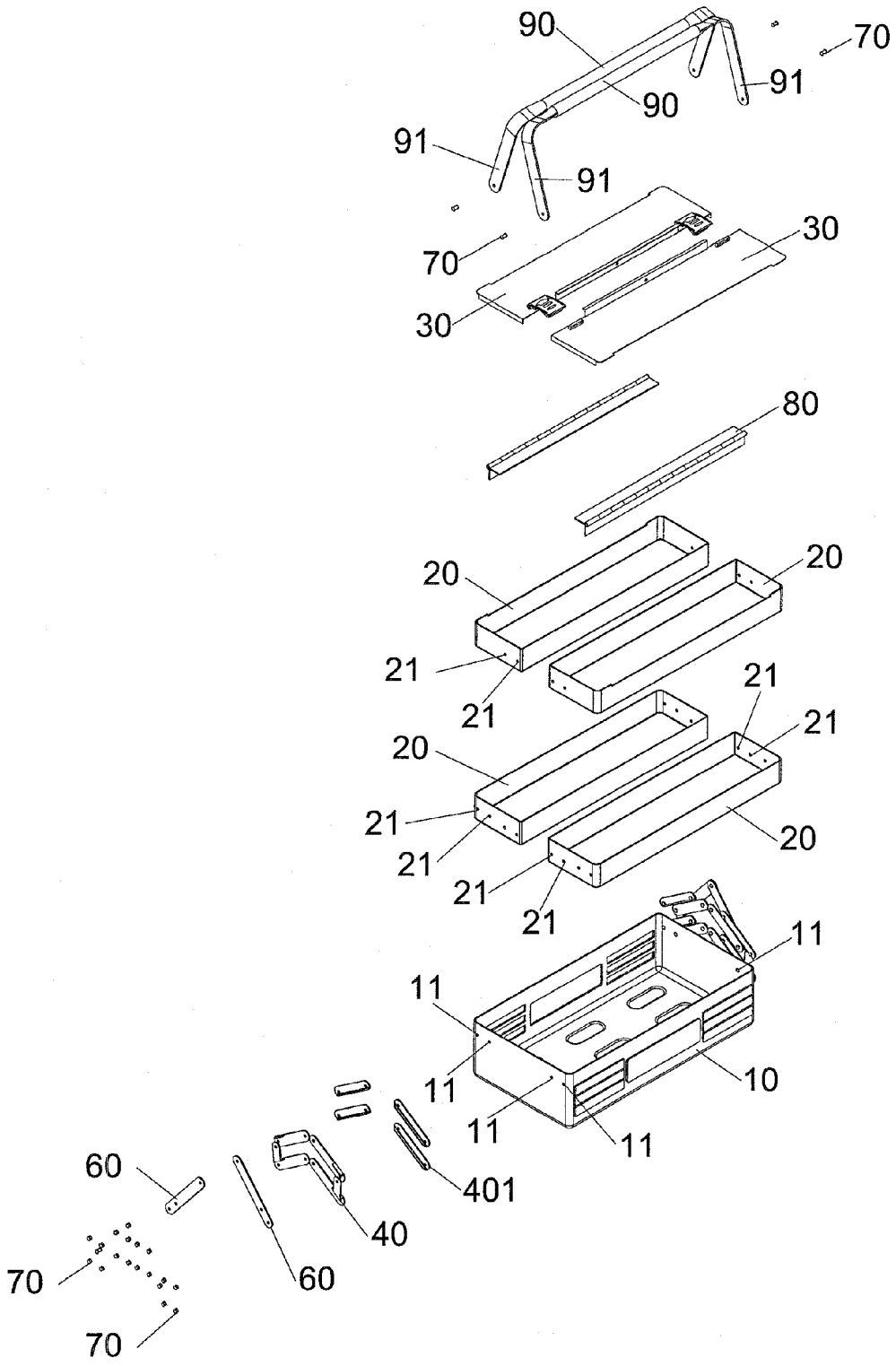
FIG. 12 is an exploded view of the second embodiment of the tool box of the present invention.
Figure 13:
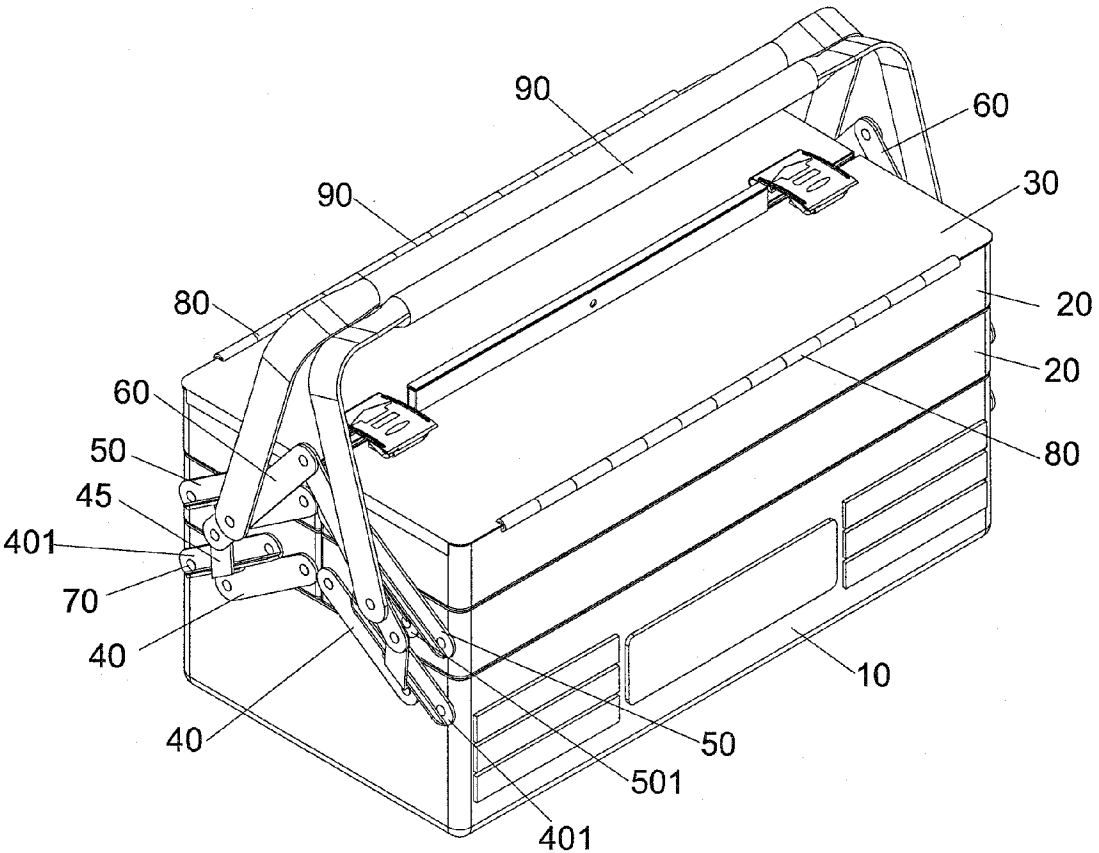
FIG. 13 is a perspective view of the second embodiment of the tool box of the present invention.

As shown in FIGS. 12 and 13, there are multiple hinges 80 and each hinge 80 is composed of two members which are pivotably connected to each other. The hinges 80 are connected to the inside of the second box 20 and the inside of the cover 30 so that the cover 30 can be pivoted relative to the second box 20.

Figure 14:
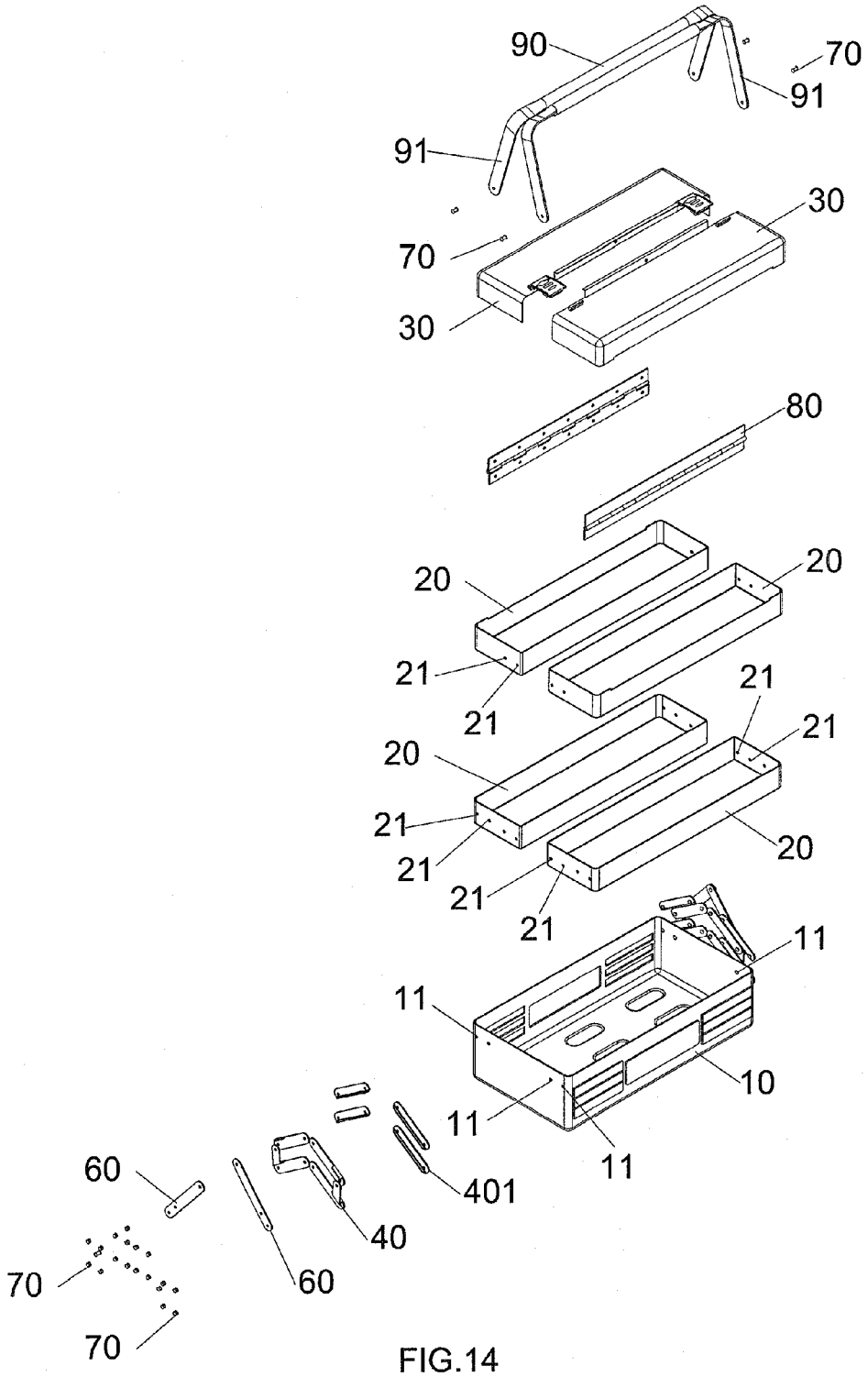
FIG. 14 is an exploded view of the third embodiment of the tool box of the present invention.
Figure 15:
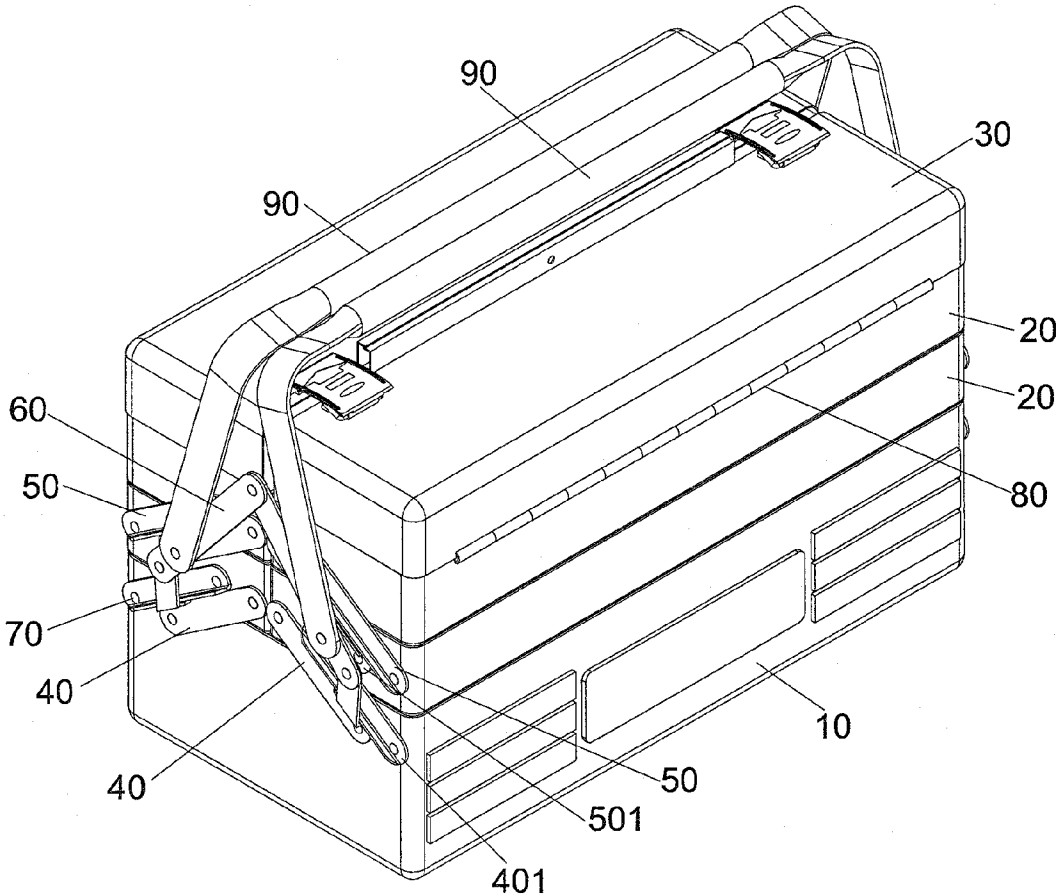
FIG. 15 is a perspective view of the third embodiment of the tool box of the present invention.
Figure 16:
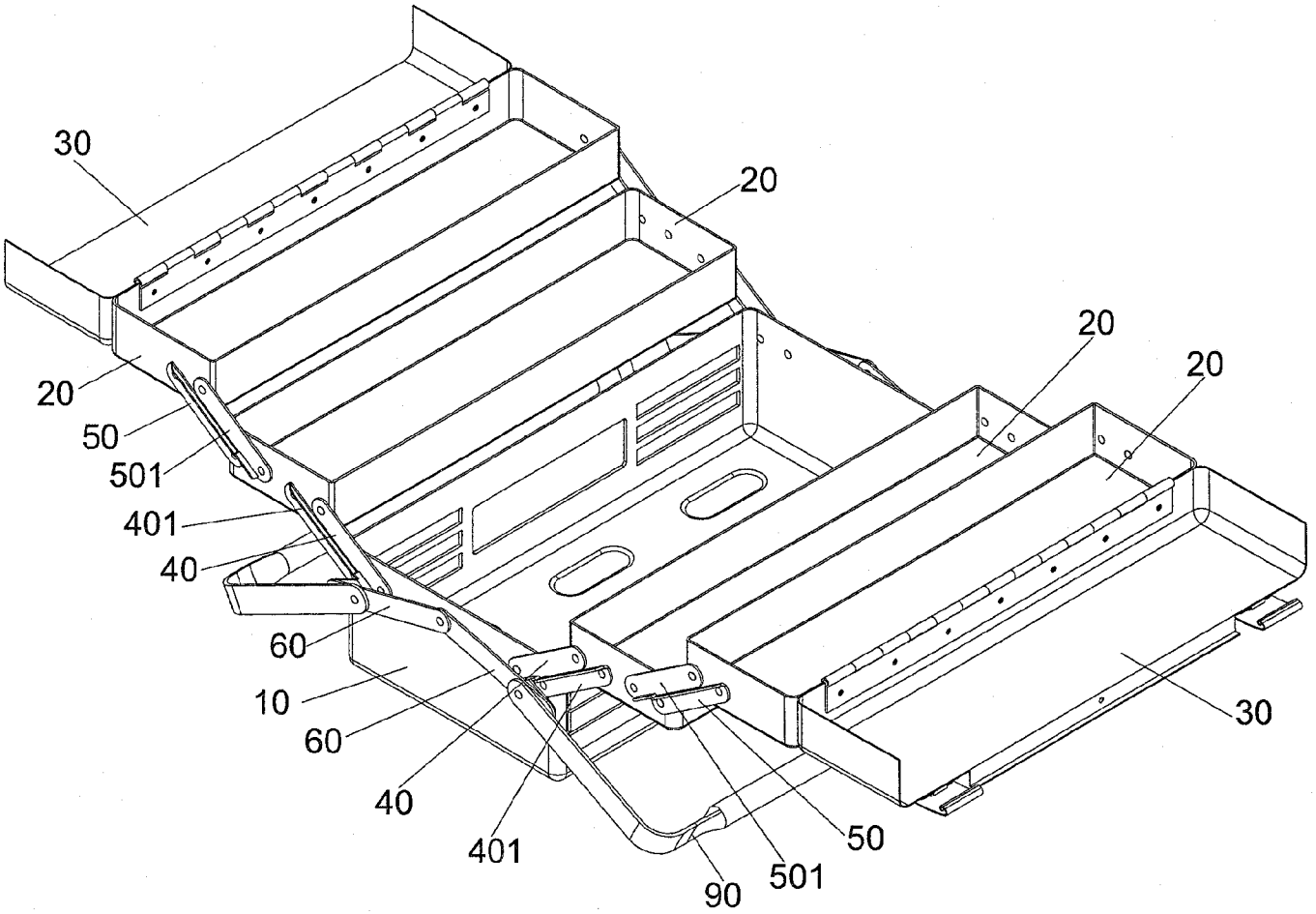
FIG. 16 is a view to show that all of the second boxes of the third embodiment of the tool box of the present invention are expanded.

FIGS. 14 to 16 show that the cover 30 is a rectangular cover and tools can be received in the cover 30.

Figure 17:
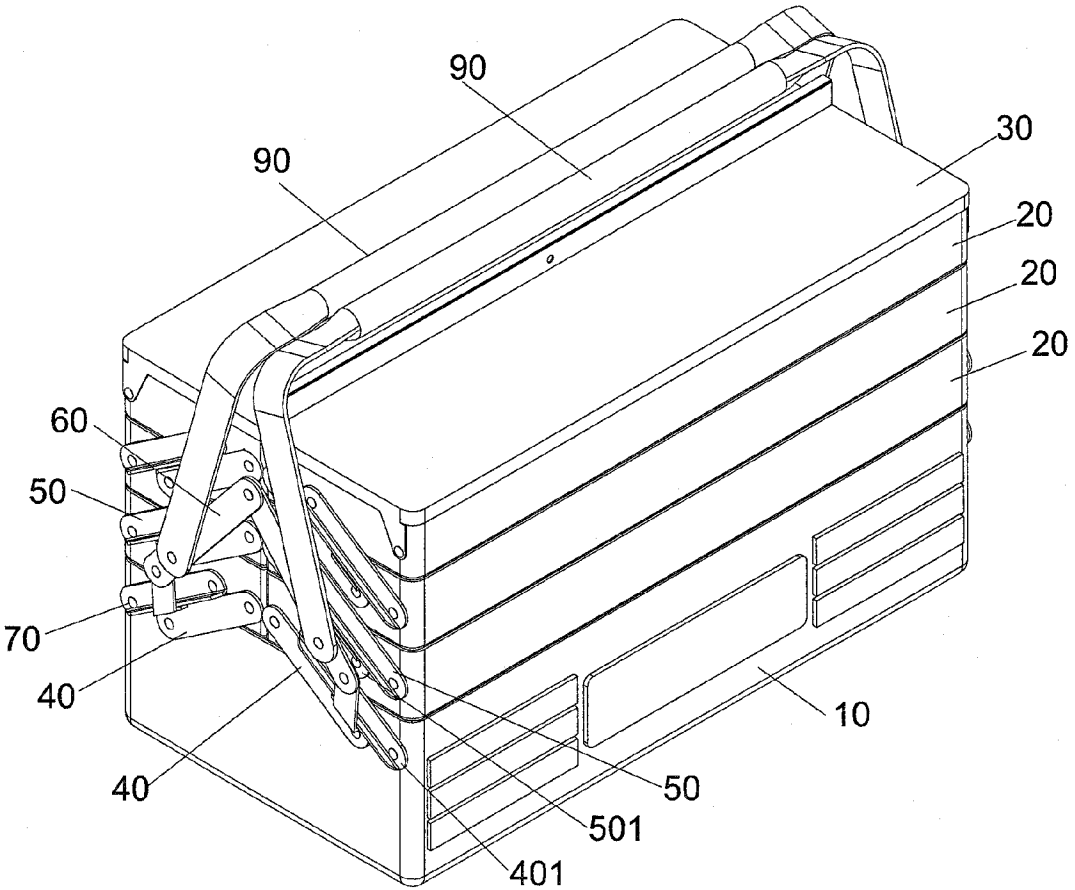
FIG. 17 is a perspective view of the fourth embodiment of the tool box of the present invention.

FIG. 17 shows that the number of the second boxes 20 is six and the six second boxes 20 are grouped in pairs in three layers. Alternatively, the number of the second boxes 20 is eight and the eight second boxes 20 are grouped in pairs in four layers. Alternatively, the number of the second boxes 20 is ten and the ten second boxes 20 are grouped in pairs in five layers. The underside of the first box 10 can be equipped with rollers if loaded with more second boxes 20 (The rollers are not shown in the figure).

Figure 18:
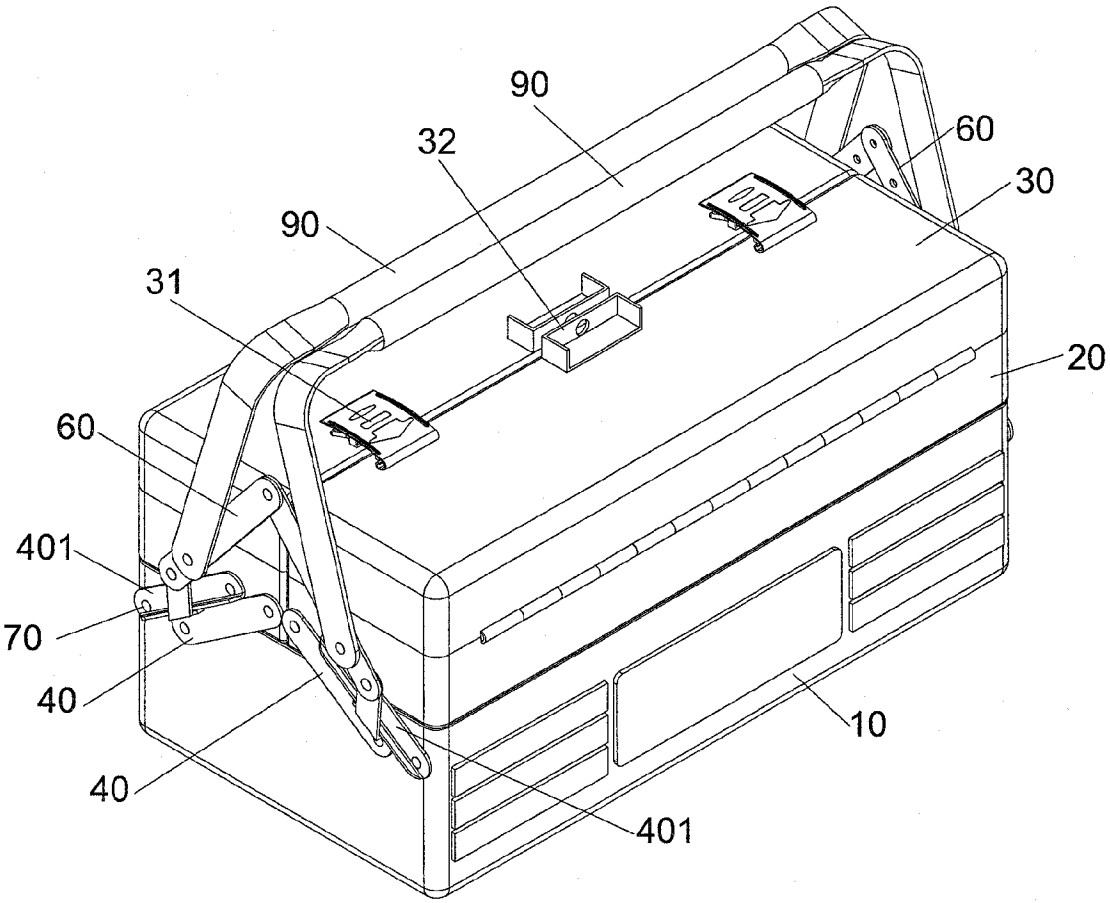
FIG. 18 is a perspective view of the fifth embodiment of the tool box of the present invention.

As shown in FIG. 18, there are only two second boxes 20 overlapped on the first box 10. The two covers 30 are connected to each other by a connection member 31. The connection members 31 can be locked by using a locking unit 32.

Figure 19:
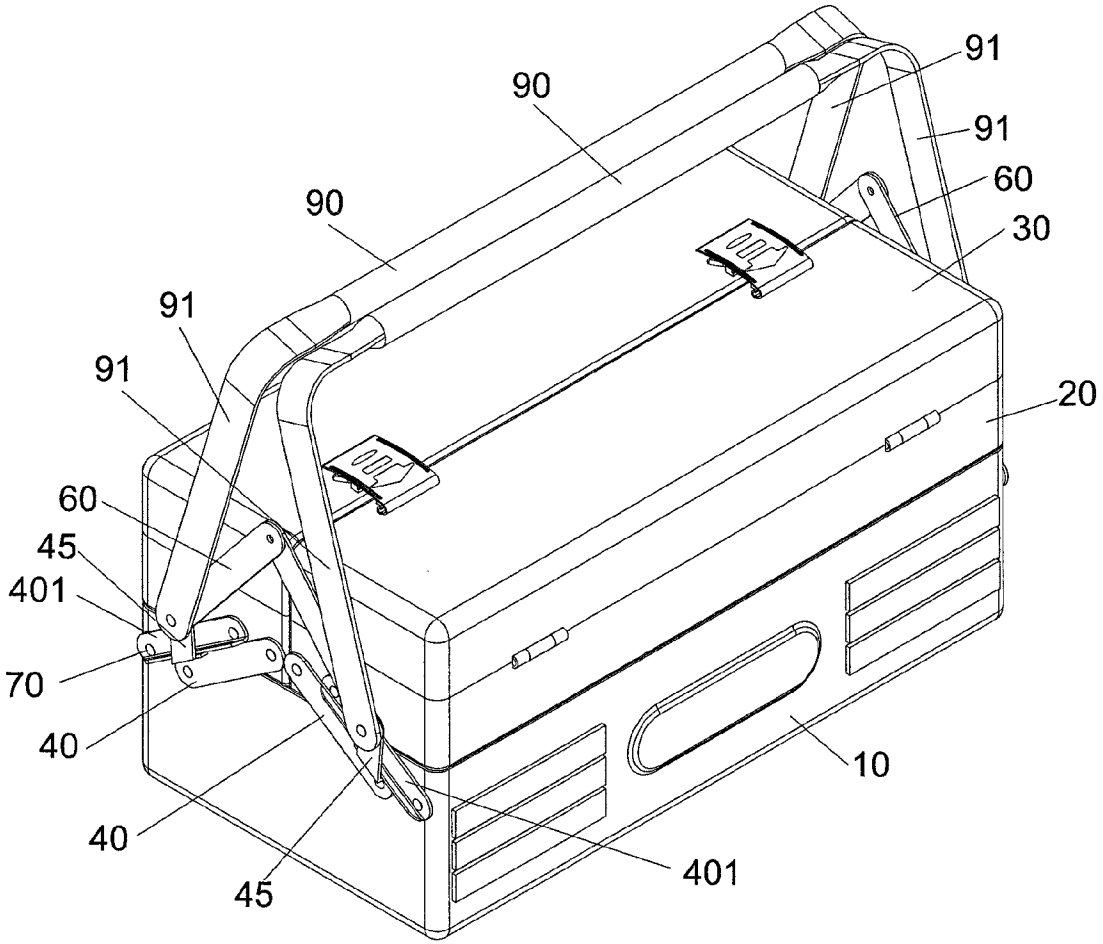
FIG. 19 is a perspective view of the sixth embodiment of the tool box of the present invention.

As shown in FIG. 19, each protrusion link 45 has a connection plate 60. The connection plates 60 on the same side of the first box 10 are pivotably connected to each other at two respective ends thereof. The connection plates 60, the arms 91 and the protrusion links 45 are coaxially and pivotably connected to each other.

Figure 20:
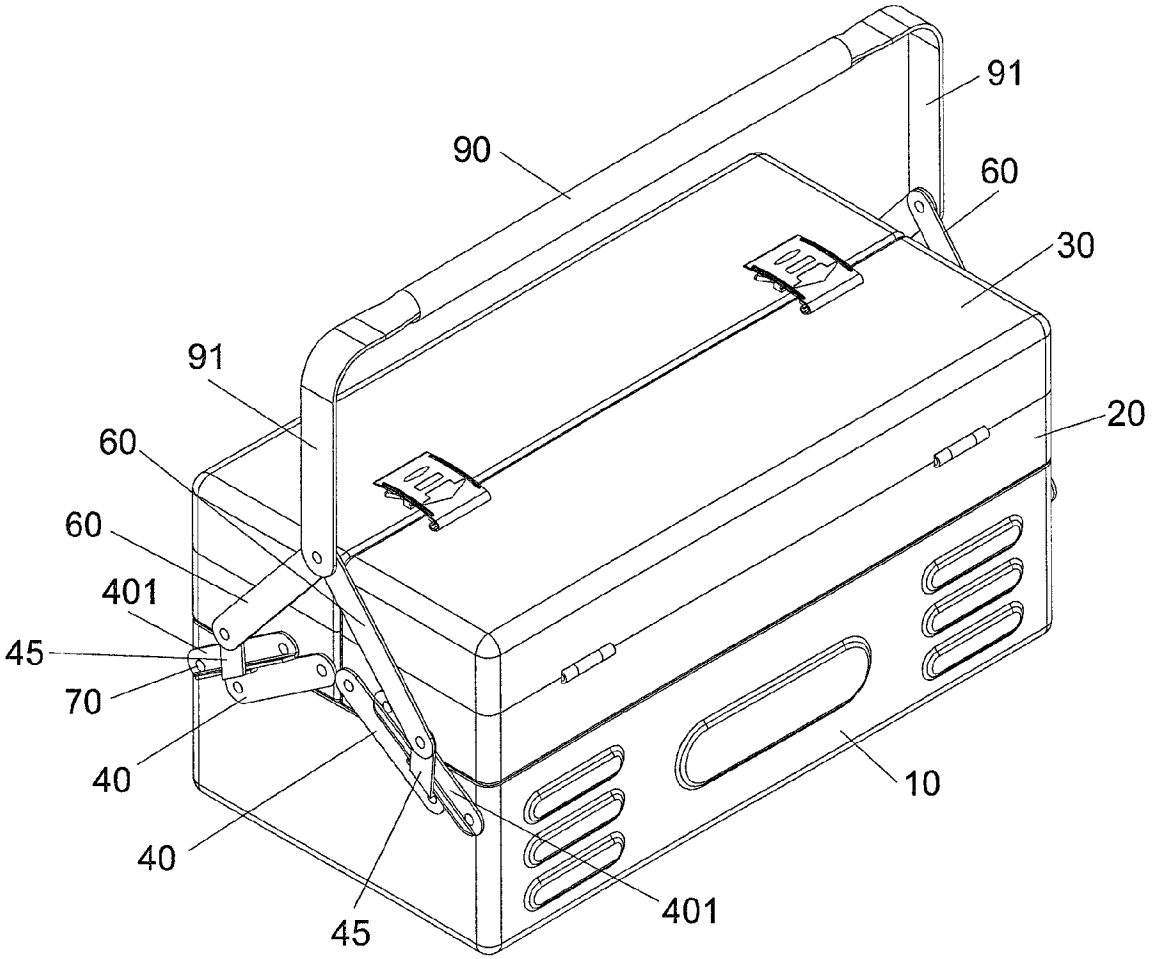
FIG. 20 is a perspective view of the seventh embodiment of the tool box of the present invention.

As shown in FIG. 20, the number of the at least one handle 90 is one and the handle 90 has at least one arm 91 on each of the two ends thereof. The at least one arm 91 is pivotably connected to two connection plates 60. The connection plates 60 on the same side of the first box 10 are pivotably connected to the protrusion links 45 corresponding thereto.

Figure 21:
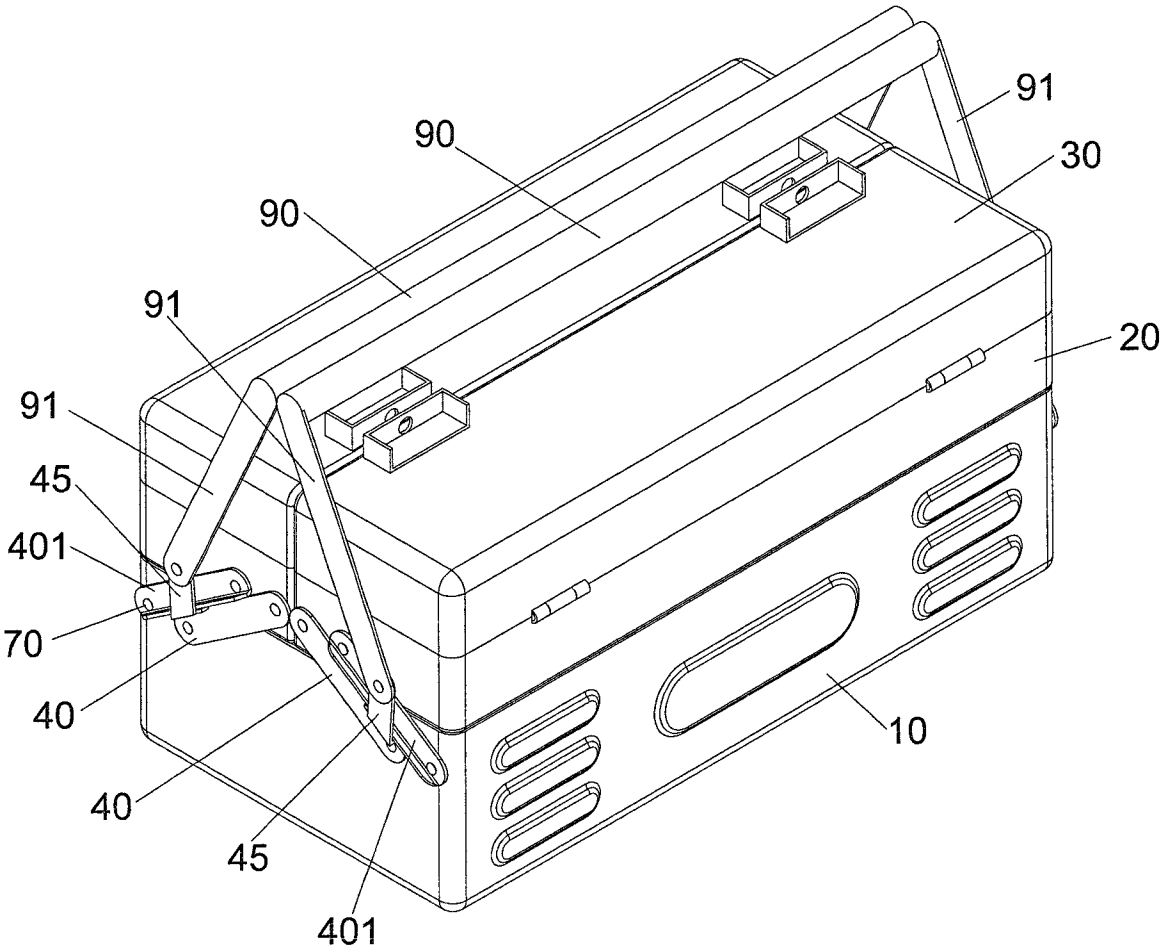
FIG. 21 is a perspective view of the eighth embodiment of the tool box of the present invention.

As shown in FIG. 21, the number of the at least one handle 90 is two and each of the two handles 90 has one arm 91 on each of the two ends thereof. Each of the arms 91 is pivotably connected to the protrusion link 45 corresponding thereto.

Figure 22:
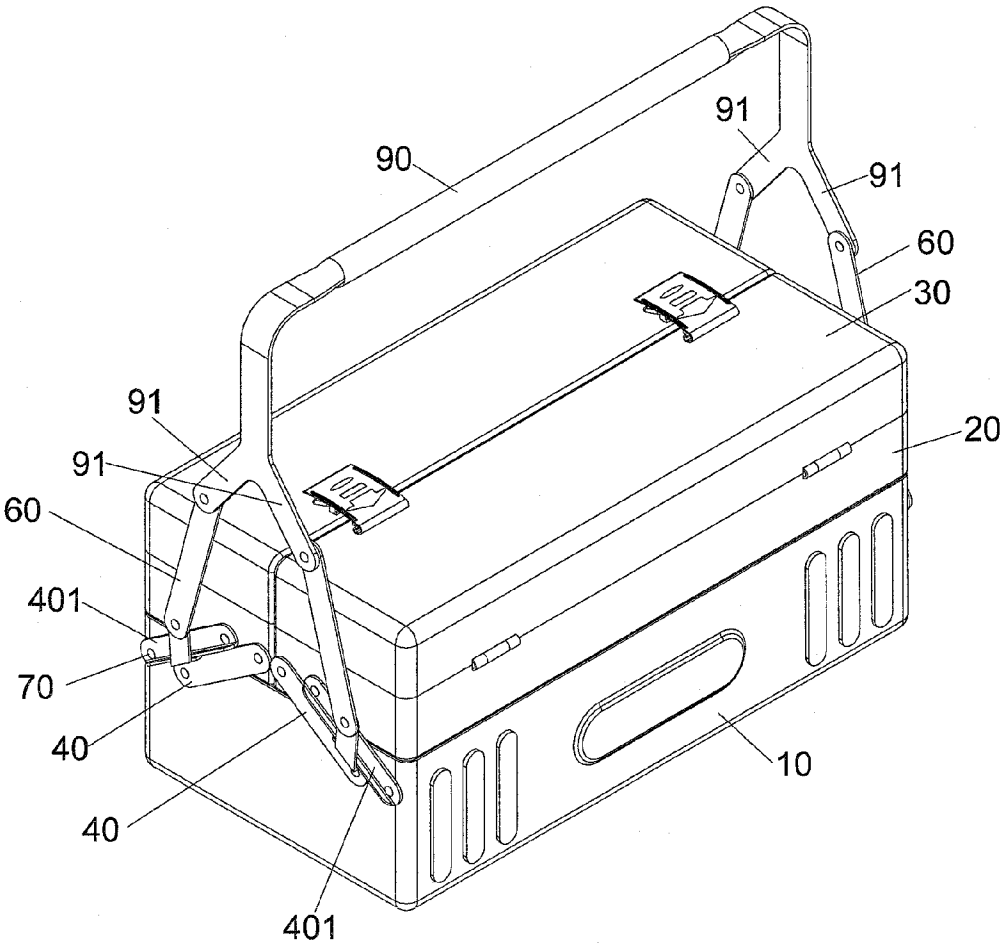
FIG. 22 is a perspective view of the ninth embodiment of the tool box of the present invention.

As shown in FIG. 22, the number of the at least one handle 90 is one and the handle 90 has one arm 91 on each of the two ends thereof. The two arms 91 are pivotably connected to two connection plates 60.

Figure 23:
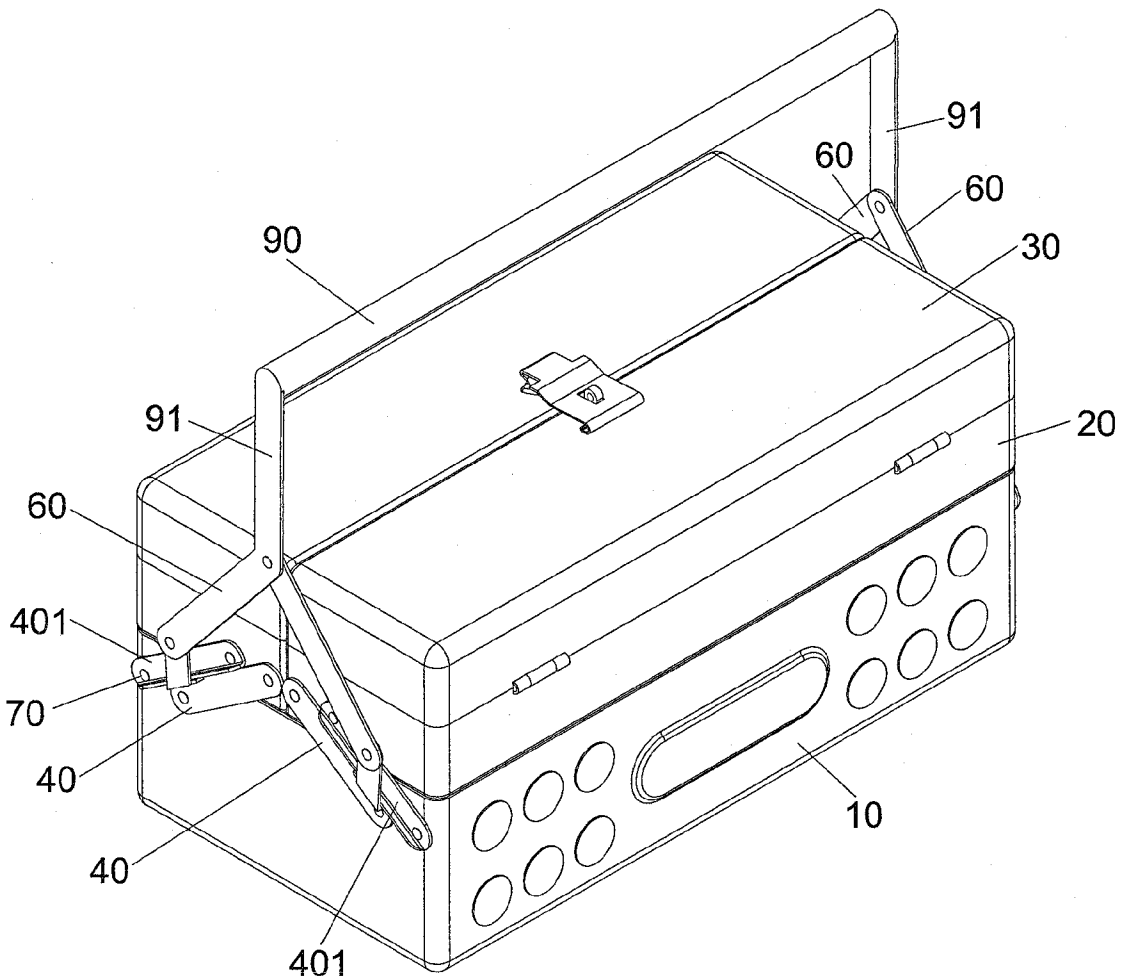
FIG. 23 is a perspective view of the tenth embodiment of the tool box of the present invention.

As shown in FIG. 23, the number of the at least one handle 90 is one and the handle 90 has one arm 91 on each of the two ends thereof. Each of the two arms 91 is pivotably connected to two respective ends of two connection plates 60. One of the two connection plates 60 is integral with the arm 91.

The advantages of the present invention are that, as shown in FIGS. 8 and 9, the first link 40 and the second link 50 are co-rotated, and the first contact portion 44 of the first link 40 contacts the second contact portion 53 of the second plate 50, the second boxes 20 are not overlapped to the first box 10 so that the users can easily pick the tools, the second boxes 20 and the covers 30 do not interfere the users. As shown in FIG. 6, when the tool box is in folded status, the second contact portion 53 contact the top of the first contact portion 44 to make the tool box be more stable. As shown in FIG. 6, when the tool box is to be stored, the arms 91 are pivoted to contact the two sides of the first box 10, the distal ends of the arms 91 do not protrude from the underside of the first box 10 so as to reduce the space required. As shown in FIG. 18, the connection member 31 locks the tool box easily and the tool box can be locked by using the locking unit 32. The layers of the second boxes 20 can be added as needed. The second boxes 20 are expanded laterally for easily picking up the tools.

While we have shown and described the embodiment in accordance with the present invention, it should be clear to those skilled in the art that further embodiments may be made without departing from the scope of the present invention.

What is claimed is:

1. A tool box comprising:

a first box having a space defined therein;

at least two second boxes being overlapped in pairs on the first box to form at least one layer, each layer including two second boxes, the second boxes located at the lowest layer being pivotably connected to two sides of the first box by first links and first plates, the at least two second boxes, the first links and the first plates forming a parallel four-link mechanism, the second boxes of two adjacent layers being pivotably connected to each other by second links and second plates, the second boxes of the adjacent layers, the second links and the second plates forming a parallel four-link mechanism, the first link and the second link each having a first contact portion extending laterally therefrom, the first links each having a protrusion link extending from one side thereof, the first plates and the second plates each having a second contact portion extending laterally therefrom, when the second boxes being expanded relative to the first box and the second boxes of the adjacent layer, the first contact portions of the first links on the same side of the first box contacting the second contact portions of the first plates, and the first contact portions of the second links on the same side of the first box contacting the second contact portions of the second plates;

two covers each being pivotably connected with the corresponding second box on the top most layer so as to cover up the second boxes on the top most layer, and at least one handle which has two ends being pivotably connected to the protrusion links of the first links on the two sides of the first box.

2. The tool box as claimed in claim 1, wherein the two covers are connected to each other by at least one connection member.

3. The tool box as claimed in claim 1, wherein the first box and the second boxes are rectangular boxes.

4. The tool box as claimed in claim 1, wherein the covers are rectangular covers.

5. The tool box as claimed in claim 1, wherein the first links, the second links, the first plates, the second plates and the protrusion links are elongate plates.

6. The tool box as claimed in claim 1, wherein the second boxes and the covers are pivotably connected to each other by multiple hinges which are located in the second boxes.

7. The tool box as claimed in claim 1, wherein the first box has rollers at an underside thereof.

8. The tool box as claimed in claim 1, wherein a number of the at least two second boxes is six and the six second boxes are grouped in pairs in three layers.

9. The tool box as claimed in claim 1, wherein a number of the at least two second boxes is eight and the eight second boxes are grouped in pairs in four layers.

10. The tool box as claimed in claim 1, wherein a number of the at least two second boxes is ten and the ten second boxes are grouped in pairs in five layers.

11. The tool box as claimed in claim 1, wherein a number of the at least one handle is two and each handle has two arms on two ends thereof, the two arms are pivotably connected to the protrusion links corresponding thereto.

12. The tool box as claimed in claim 11, wherein each protrusion link has a connection plate, the connection plates on the same side of the first box are pivotably connected to each other at two respective ends thereof.

13. The tool box as claimed in claim 12, wherein the connection plates, the arms and the protrusion links are coaxially and pivotably connected to each other.

14. The tool box as claimed in claim 1, wherein a number of the at least one handle is one and the handle has at least one arm on each of the two ends thereof, the at least one arm is pivotably connected to two connection plates, the connection plates on the same side of the first box are pivotably connected to the protrusion links corresponding thereto.

15. The tool box as claimed in claim 14, wherein the handle has one arm on each of the two ends thereof, each of the arms is pivotably connected to two connection plates, two respective ends of the two connection plates are pivotably connected to each other, one of the connection plates is integrally formed with the arm.

16. The tool box as claimed in claim 14, wherein the handle has one arm on each of the two ends thereof, each of the arms is pivotably connected to two respective ends of the two connection plates.

17. The tool box as claimed in claim 1, wherein a contact area between the first contact portion and the second contact portion is a flat surface, a width of the flat surface is larger than a thickness of the first link, the first plate, the second link and the second plate.

18. The tool box as claimed in claim 1, wherein each of the protrusion links has a hole through which a pivot extends to pivotably connect one end of the connection plate, the other two respective ends of the two connection plates on the same side of the first box are pivotably connected to each other, the connection plates has a hole defined through a middle portion thereof, a pivot extends through the hole in the middle portion of the connection plate to be pivotably connected to the arm of the handle.

* * * * *